US010696086B2

(12) United States Patent
Morishita

(10) Patent No.: US 10,696,086 B2
(45) Date of Patent: Jun. 30, 2020

(54) BINDING TOOL AND FILE

(71) Applicant: YUGEN KAISHA SANKUSU, Toyoake-shi, Aichi-ken (JP)

(72) Inventor: Akinori Morishita, Toyoake (JP)

(73) Assignee: YUGEN KAISHA SANKUSU, Toyoake-shi (JP)

( * ) Notice: Subject to any disclaimer, the term of this patent is extended or adjusted under 35 U.S.C. 154(b) by 0 days.

(21) Appl. No.: 16/599,601

(22) Filed: Oct. 11, 2019

(65) Prior Publication Data

US 2020/0039281 A1 Feb. 6, 2020

Related U.S. Application Data

(63) Continuation of application No. 15/745,675, filed as application No. PCT/JP2015/075825 on Sep. 11, 2015, now Pat. No. 10,479,132.

(51) Int. Cl.
*B42F 13/22* (2006.01)
*B42F 13/18* (2006.01)

(52) U.S. Cl.
CPC ..... *B42F 13/22* (2013.01); *B42F 13/18* (2013.01); *B42P 2241/08* (2013.01)

(58) Field of Classification Search
CPC ..... B42F 13/22; B42F 13/18; B42P 2241/08
USPC ..... 402/4, 19, 20, 26, 31, 70, 73
See application file for complete search history.

(56) References Cited

U.S. PATENT DOCUMENTS 2,985,173 A 5/1961 White
6,203,229 B1 * 3/2001 Coerver ..... B42F 13/26 402/20
2005/0100395 A1 5/2005 Brann
2010/0034576 A1 2/2010 Tanaka et al.
(Continued)

FOREIGN PATENT DOCUMENTS

CN 2470121 Y 1/2002
CN 1346317 A 4/2002
CN 101541557 A 9/2009
(Continued)

OTHER PUBLICATIONS

Mar. 13, 2018 International Preliminary Report on Patentability issued in International Patent Application No. PCT/JP2015/075825.
(Continued)

*Primary Examiner* — Justin V Lewis
(74) *Attorney, Agent, or Firm* — Oliff PLC

(57) ABSTRACT

A binding tool for paper sheets includes a base member extending in a longitudinal direction; and a plurality of first binding members and second binding members each having a base end portion formed protruding outward in a width direction from the base member and a tip end portion integral with the base end portion and curved inward in the width direction so as to be movable between a binding position where the tip end portions contact each other and an open position where the tip end portions are separated from each other by a prescribed distance. The base end portions are positionally displaced from each other by at least an amount corresponding to a thickness TH of the base end portion in the longitudinal direction when the tip end portions positioned facing each other in the width direction are in contact with each other in the binding position.

4 Claims, 16 Drawing Sheets

(56) References Cited

U.S. PATENT DOCUMENTS

2010/0150642 A1 6/2010 Lee

FOREIGN PATENT DOCUMENTS

| | | | |
|---|---|---|---|
| CN | 101616810 | A | 12/2009 |
| JP | 2003-211886 | A | 7/2003 |
| JP | 2010-274544 | A | 12/2010 |

OTHER PUBLICATIONS

Aug. 10, 2018 Office Action issued in U.S. Appl. No. 15/745,675.

* cited by examiner

BINDING TOOL AND FILE

CROSS-REFERENCE TO RELATED APPLICATIONS

This is a Continuation Application of U.S. application Ser. No. 15/745,675 filed on Jan. 17, 2018, which is a national phase application based on the PCT International Patent Application No. PCT/JP2015/075825 filed on Sep. 11, 2015, the entire contents of which are incorporated herein by reference.

TECHNICAL FIELD

The present invention relates to a binding tool capable of holding papers and the like in an open state, and a file provided with the binding tool.

BACKGROUND ART

For instance, Patent Document 1 discloses, as a file provided with a binding tool for holding papers such as documents in an open state, a file 100 including a front cover 102 and a back cover 103 continuous with each other through a spine 101 interposed therebetween, and a binding tool 200 attached on an inner surface of the spine 101 as shown in FIGS. 17-20. The binding tool 200 is provided with a base member 201 extending in a longitudinal direction of the spine 101, a plurality of movable-side binding members 202 supported to be rotatable in the width direction at one end in a width direction of the base member 201, a plurality of fixed-side binding members 203 arranged in positions at the other end in the width direction of the base member 201 to correspond to the binding members 202, and a slide member 204 held in the base member 201.

Patent Document 2 discloses, as a file provided with a binding tool for holding papers such as documents in an open state, a file 300 including a front cover 302 and a back cover 303 continuous with each other through a spine 301 interposed therebetween, and a binding tool 400 attached on an inner surface of the spine 301 as shown in FIG. 21. The binding tool 400 is provided with a base member 401 extending in a longitudinal direction of the spine 301 and a plurality of first binding members 402 and a plurality of second binding members 403, each supported to be rotatable in the width direction by the base member 401. Furthermore, the front cover 302 and the back cover 303 are formed with long holes 304 for receiving parts of the corresponding first binding members 402 and second binding members 403 when the front cover 302 and the back cover 303 are placed in a substantially parallel, closed position.

RELATED ART DOCUMENTS

Patent Documents

Patent Document 1: JP 2003-211886 A
Patent Document 2: JP 2010-274544 A

SUMMARY OF INVENTION

Problems to be Solved by the Invention

However, in the binding tool 200 disclosed in Patent Document 1, when each pair of the movable-side binding members 202 and the fixed-side binding members 203 are positioned in each binding position (see FIG. 19), an overall size of the paired binding members 202 and 203 in the width direction is substantially equal to the width of the base member 201. Therefore, the quantity of papers (the number of sheets of paper) allowed to be held by the binding tool 200 is limited by the width of the base member 201. In general, a binding tool for holding papers needs to be designed so that an overall size of a binding member at a binding position is set with an allowance to the degree that allows each paper to be smoothly turned in consideration of a distance of a paper portion from a binding hole to a paper edge of each paper.

Accordingly, to increase the quantity of papers that can be held by the binding tool 200 in Patent Document 1, the width of the base member 201 has to be further increased while taking into account the allowance. In this case, regardless of the quantity of papers to be actually held by the binding tool 200, when closed, the thickness of the file 100 in the width direction becomes large. It therefore has been impossible to provide a file that is compact in the width direction when closed while allowing an increased number of sheets (thickness) of paper to be held by the binding tool 200.

In the binding tool 200 disclosed in Patent Document 1, a rotary shaft 205 supporting the movable-side binding members 202 is placed in the base member 201 and further a plurality of cam guide mechanisms 206 are provided between the rotary shaft 205 and the slide member 204. When the slide member 204 is slid in the longitudinal direction, the movable-side binding members 202 rotate between a binding position (see FIG. 19) and an open position (see FIG. 20) according to positional changes of the cam guide mechanisms 206.

Accordingly, the base member 201 internally contains the rotary shaft 205, the slide member 204, and the cam guide mechanisms 206, resulting in a complicated structure. This leads to a problem that the width of the base member 201 is apt to be wide and the binding tool 200 could not be compact in the width direction in the binding position.

On the other hand, the binding tool 400 disclosed in Patent Document 2 is designed such that when each pair of the first binding members 402 and the second binding members 403 is placed in the binding position where they are in contact with each other, the overall size of each pair is slightly larger than the width of base member 401, and the front cover 302 and the back cover 303 are each formed with the long holes 304 allowing parts of the first binding members 402 and second binding members 403 to enter. Accordingly, a file compact in the width direction when closed may be provided with the increased quantity of papers allowed to be held by the binding tool 400.

However, the aforementioned binding tool 400 is formed with the first binding members 402 and the second binding members 403, each pair being arranged in straight line in the width direction perpendicular to the longitudinal direction. Thus, when a plurality of files 300, each holding papers through the binding tool 400, are stored on for example a bookshelf and the like such that the files 300 with the longitudinal direction of each spine 301 upright are arranged side by side to overlap an adjacent file(s), the first binding members 402 of one file 300 comes into contact with the second binding members 403 of an adjacent file 300 in the width direction. This causes a problem that, when files are stored to overlap an adjacent one(s) in the bookshelf and the like, the number of files to be stored is decreased.

The present invention has been made to solve the above problems and has a purpose to provide a binding tool having a compact size in a width direction in a binding position and a file provided with the binding tool, which can increase the number of files to be stored with a longitudinal direction of each spine mounted on each base member upright on a bookshelf and the like.

Means of Solving the Problems (1) To achieve the aforementioned purpose, one aspect of the invention provides a binding tool for papers, comprising: a base member extending in a longitudinal direction; and a plurality of first binding members and a plurality of second binding members, each having a base end portion protruding outward in a width direction from the base member and a tip end portion integral with the base end portion and curved inward in the width direction, wherein the tip end portions located facing each other in the width direction are movable between a binding position in which the tip end portions are in contact with each other and an open position in which the tip end portions are separated by a predetermined distance, wherein when the tip end portions located facing each other in the width direction are in contact with each other in the binding position, the base end portions integral with the corresponding tip end portions are positionally displaced from each other in the longitudinal direction by at least an amount corresponding to a thickness of each base end portion.

(2) In the binding tool disclosed in (1), preferably, the tip end portions of the first binding members and the tip end portions of the second binding members, located facing each other in the width direction, are joined to each other at a slant with a predetermined angle with respect to the longitudinal direction in the binding position.

(3) In the binding tool disclosed in (2), preferably, each of the tip end portions of the first binding members and each of the tip end portions of the second binding members, located facing each other in the width direction, extend to taper off to a distal end in the width direction, and each of the tapering tip end portions is provided with a contact surface perpendicular to the longitudinal direction.

(4) In the binding tool disclosed in one of (1) to (3), preferably, the base member includes a first base member formed with the first binding members and a second base member formed with the second binding members, and the first base member and the second base member overlap each other in an up-down direction perpendicular to the longitudinal direction in the binding position.

(5) In the binding tool disclosed in (4), preferably, the first base member and the second base member are provided with engagement portions each protruding in the up-down direction and being located in positions where the base members overlap one on the other in a central part, a front end part, and a rear end part of each base member in the longitudinal direction.

(6) In the binding tool disclosed in (4) or (5), preferably, the first base member and the second base member are coupled to each other to be movable in the width direction through a plurality of link arm members.

(7) In the binding tool disclosed in (6), preferably, each of the first base member and the second base member is configured in a multi-layer structure that a plurality of plate-like parts extending in the longitudinal direction are stacked so that a clearance is formed therebetween in the up-down direction and the link arm members are allowed to be housed in the clearance in the binding position.

(8) In the binding tool disclosed in (7), preferably, each of the link arm members includes a first arm element to be housed in the clearance of the first base member and a second arm element to be housed in the clearance of the second base member in the binding position, the first arm element and the second arm element being coupled stepwise to each other at a link middle portion.

(9) To achieve the above purpose, another aspect of the invention provides a file provided with the binding tool according to any one of (1) to (8), a front cover, and a back cover, wherein the front cover and the back cover are provided with insertion holes to allow the base end portions of the first binding members and the base end portions of the second binding members to be inserted, two in each hole, side by side in the longitudinal direction.

(10) In the file disclosed in (9), preferably, a spine, the front cover, and the back cover are provided with operating cutouts to allow operation of a front end part and/or a rear end part of the binding tool in the longitudinal direction.

(11) The file disclosed in (9) or (10) preferably includes a spine through which the front cover and the back cover are continuous with each other, and the base member includes a flanged locking portion engageable with a locking hole formed in the spine.

(12) In the file disclosed in one of (9) to (11), preferably, the first binding member and the second binding member are arranged with pitches so that a pitch on a central side in the longitudinal direction is wider than a pitch on a front end side and on a rear end side, and further arranged symmetrically on the front end side and the rear end side in the longitudinal direction.

Effects of the Invention

The present invention can provide a binding tool compact in a width direction in a binding position and a file provided with the binding tool such that when the files are stored with the longitudinal direction of their spines upright on a bookshelf and the like, the files can overlap, or contact, each other, resulting in an increase in the number of files to be stored.

MODE FOR CARRYING OUT THE INVENTION

A detailed description of preferred embodiments of a binding tool and a file provided with the binding tool embodying the present invention will now be given referring to the accompanying drawings. The structure of the binding tool according to an embodiment of the invention is described first and then the structure of the file including the binding tool according to a second embodiment of the invention.

<Structure of Binding Tool>

Figure 1:
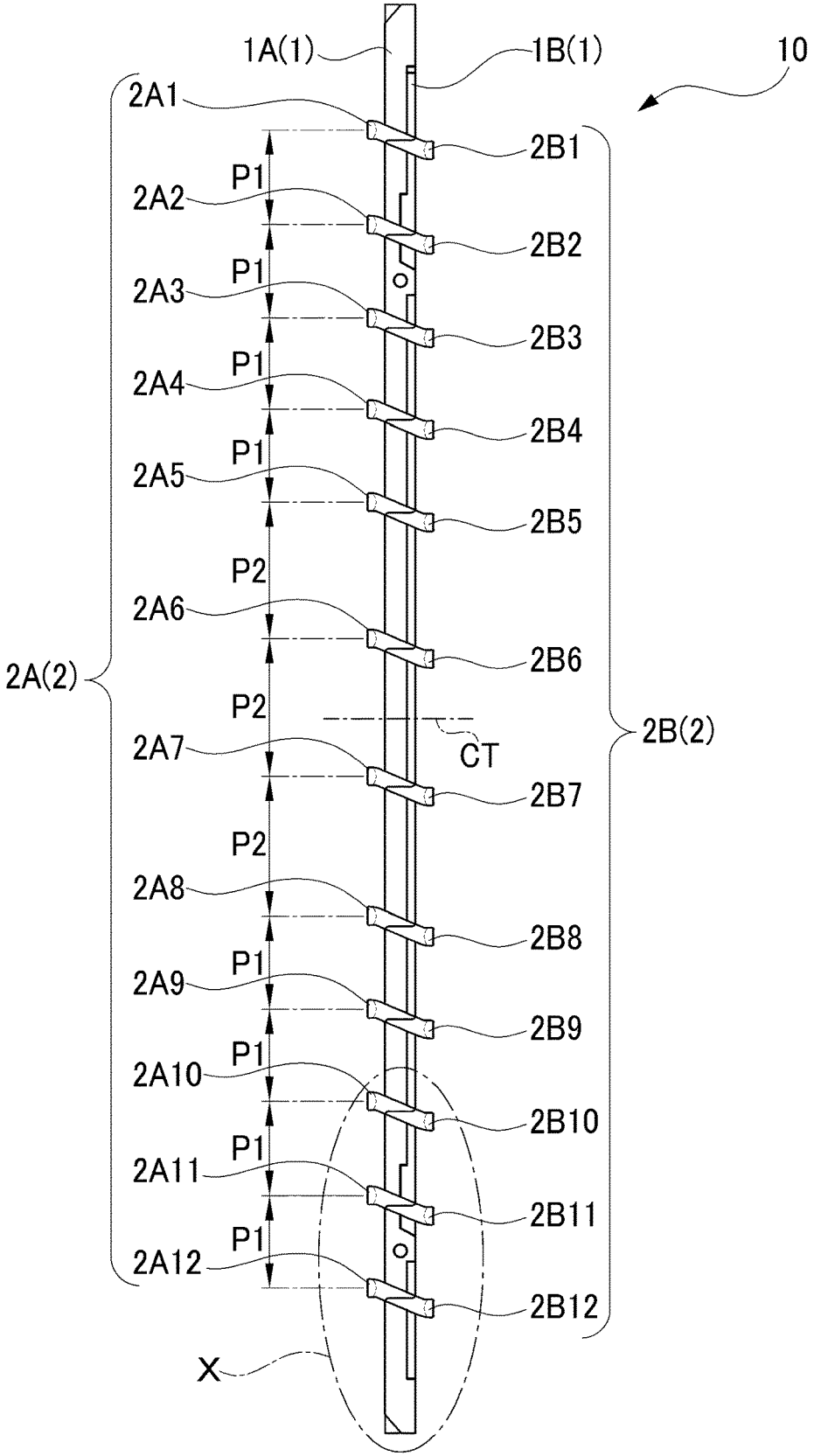
FIG. 1 is a plan view of a binding tool in a binding position in an embodiment of the present invention.
Figure 2:
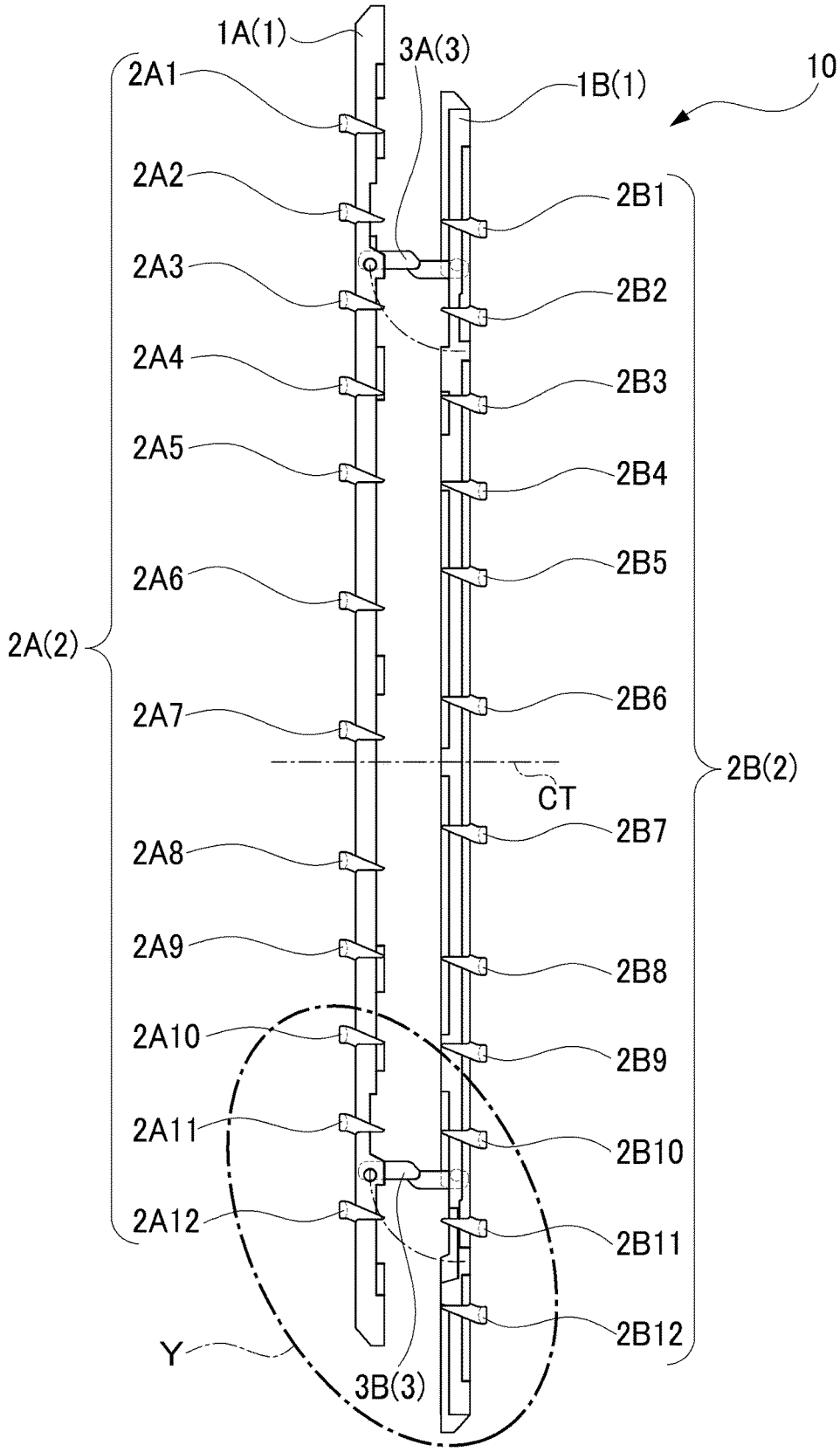
FIG. 2 is a plan view of the binding tool shown in FIG. 1, in an open position.
Figure 3:
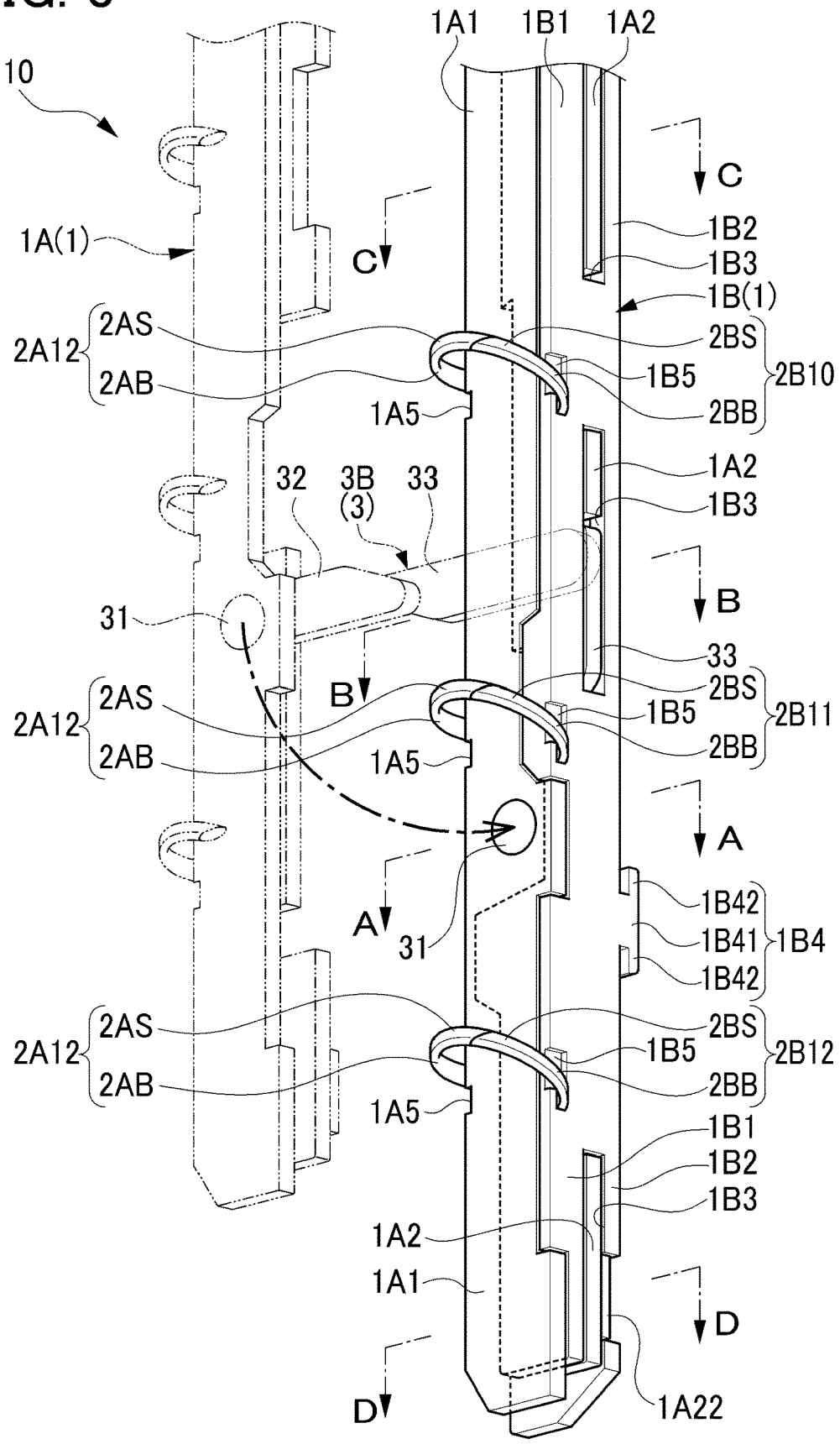
FIG. 3 is a perspective view of a part X of the binding tool shown in FIG. 1.
Figure 4:
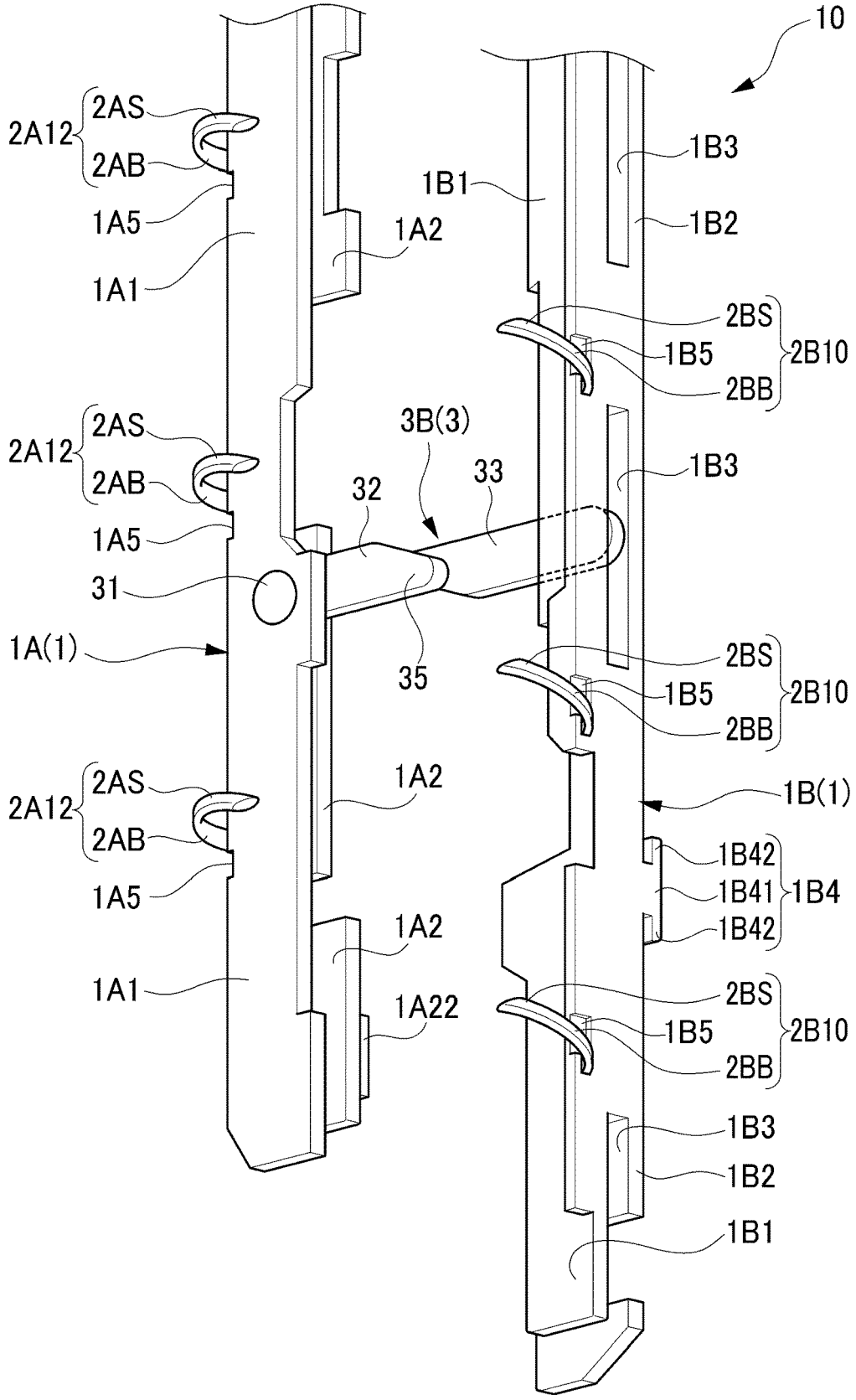
FIG. 4 is a perspective view of a part Y of the binding tool shown in FIG. 2.
Figure 5:
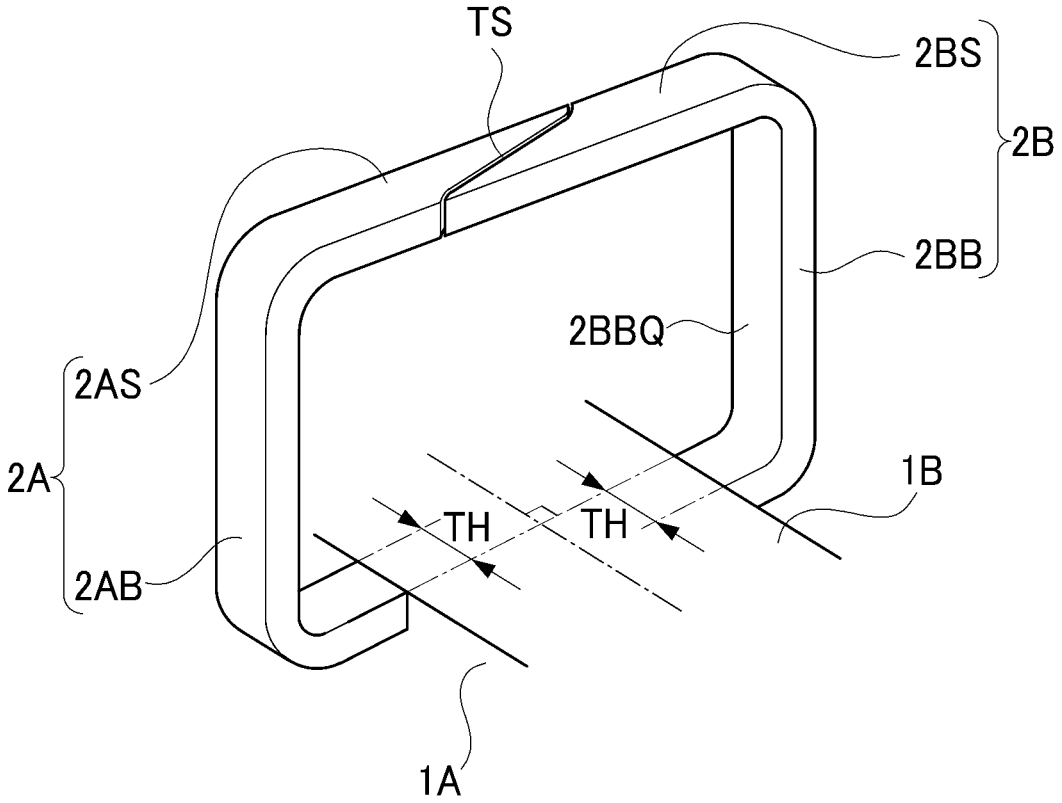
FIG. 5 is a detailed perspective view of a first binding member and a second binding member of the binding tool shown in FIG. 1.
Figure 6:
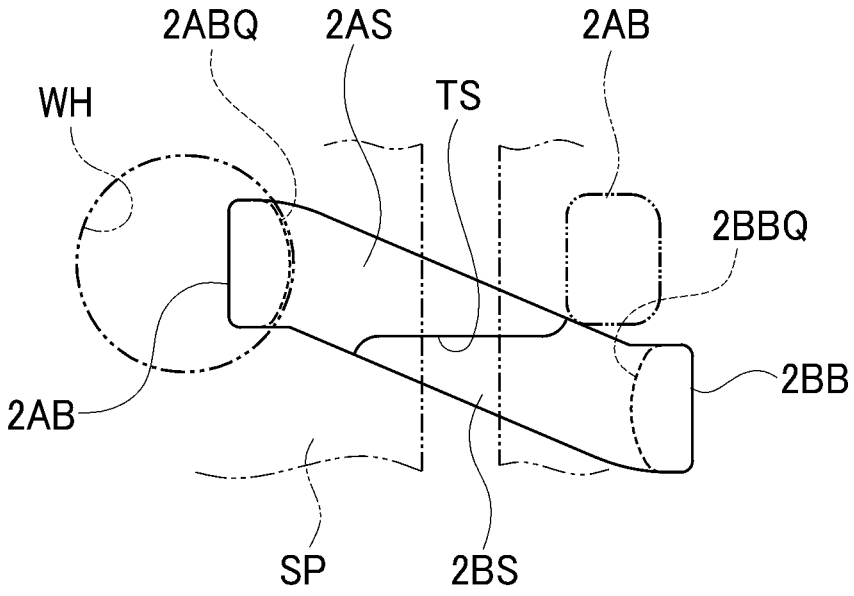
FIG. 6 is a plan view of the first binding member and the second binding member shown in FIG. 5.
Figure 7:
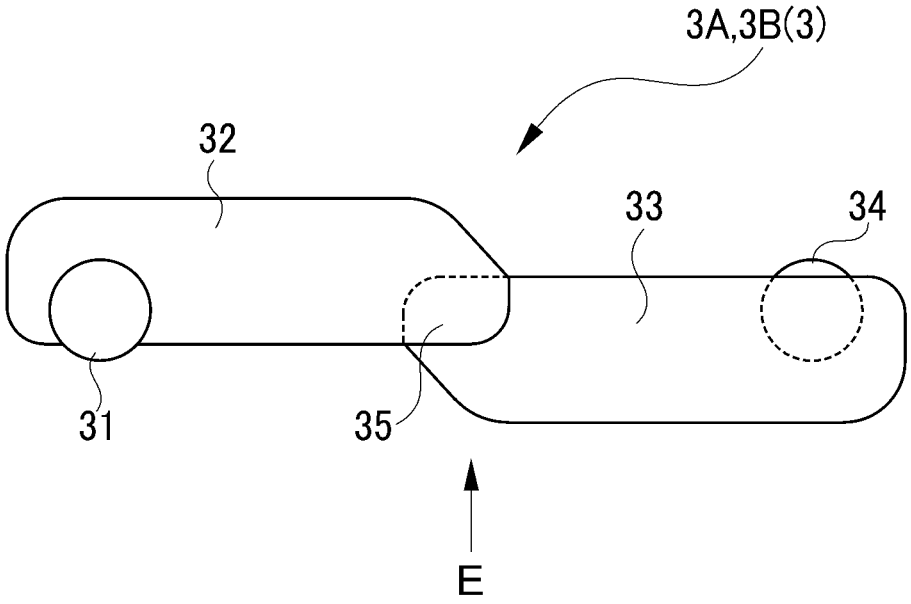
FIG. 7 is a plan view of a link arm member of the binding tool shown in FIG. 2.
Figure 8:
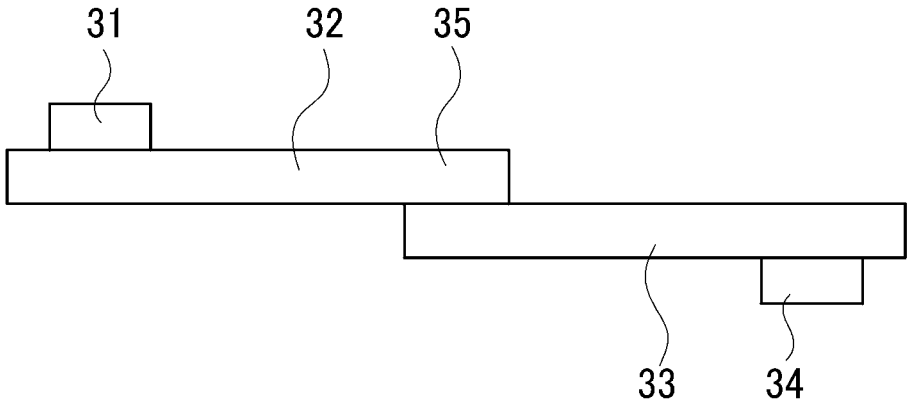
FIG. 8 is a side view of the link arm member seen from E in FIG. 7.
Figure 9:
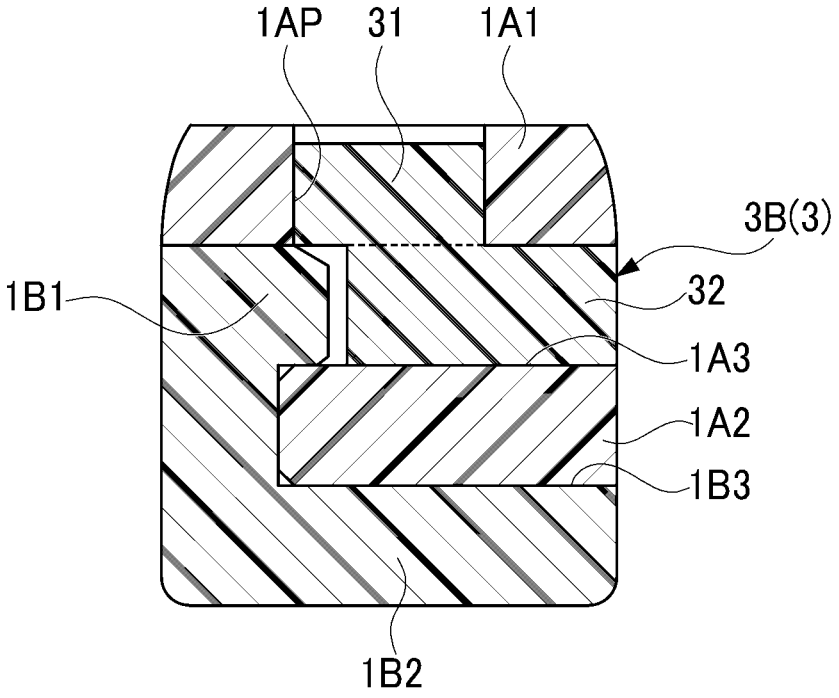
FIG. 9 is a cross-sectional view taken along a line A-A in FIG. 3.
Figure 10:
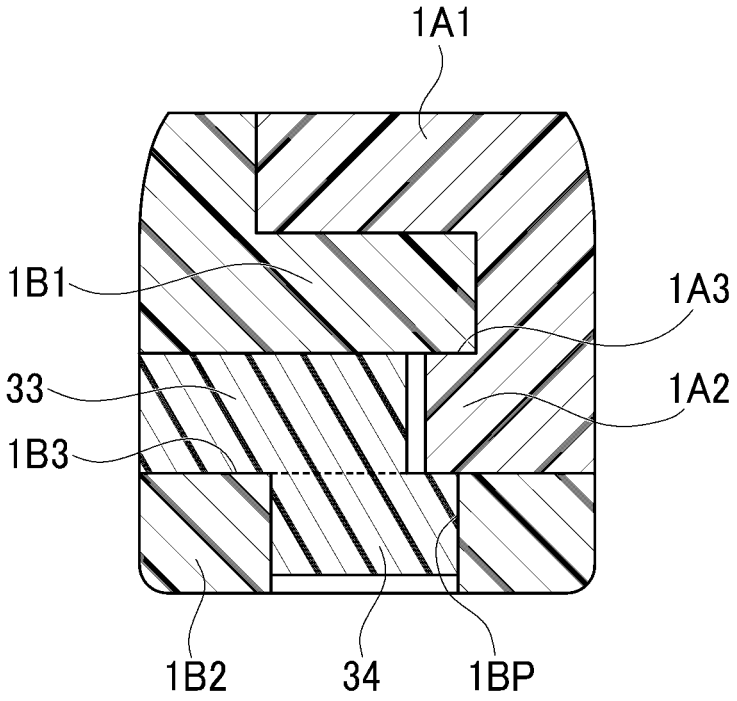
FIG. 10 is a cross-sectional view taken along a line B-B in FIG. 3.
Figure 11:
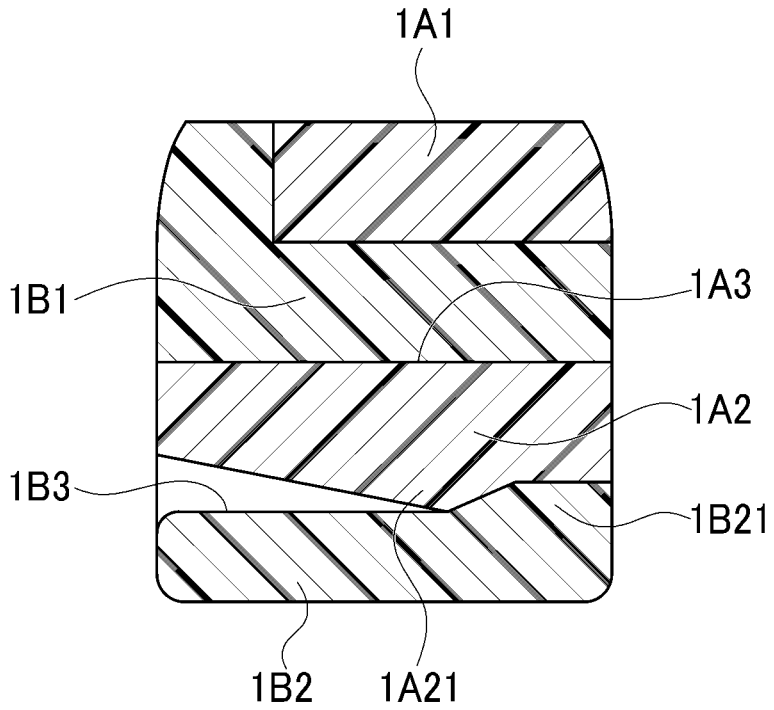
FIG. 11 is a cross-sectional view taken along a line C-C in FIG. 3.
Figure 12:
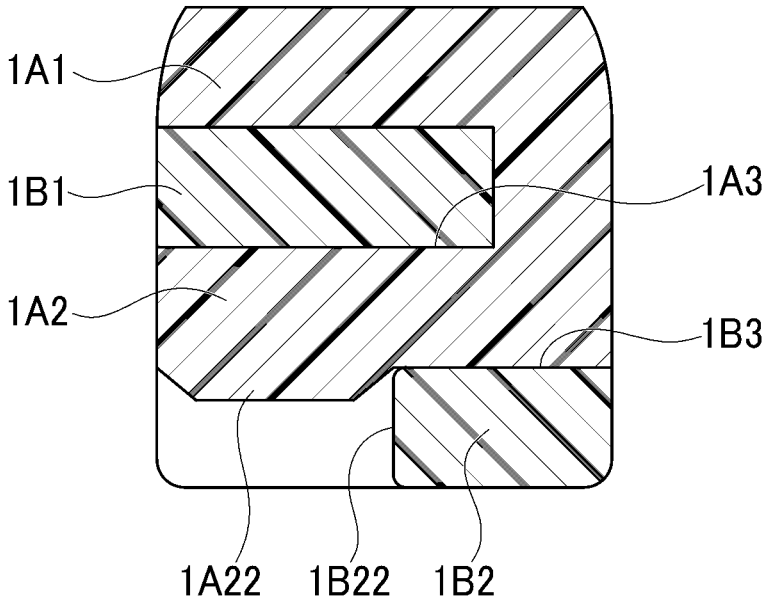
FIG. 12 is a cross-sectional view taken along a line D-D in FIG. 3.

Referring to FIGS. 1 to 12, firstly, the structure of the binding tool in the present embodiment will be described below. FIG. 1 is a plan view of a binding tool in a binding position in the embodiment of the invention. FIG. 2 is a plan view of the binding tool of FIG. 1 in an open position. FIG. 3 is a perspective view of a part X of the binding tool of FIG. 1. FIG. 4 is a perspective view of a part Y of the binding tool of FIG. 2. FIG. 5 is a detailed perspective view of a first binding member and a second binding member in the binding tool of FIG. 1. FIG. 6 is a plan view of the first binding member and the second binding member of FIG. 5. FIG. 7 is a plan view of a link arm member of the binding tool of FIG. 2. FIG. 8 is a side view of the link arm member seen from E in FIG. 7. FIG. 9 is a cross-sectional view taken along a line A-A in FIG. 3. FIG. 10 is a cross-sectional view taken along a line B-B in FIG. 3. FIG. 11 is a cross-sectional view taken along a line C-C in FIG. 3. FIG. 12 is a cross-sectional view taken along a line D-D in FIG. 3.

As shown in FIGS. 1 to 12, a binding tool 10 in the present embodiment is a binding tool for papers, including a base member 1 (1A and 1B) extending in a longitudinal direction and a plurality of first binding members 2A (2A1 to 2A12) and a plurality of second binding members 2B (2B1 to 2B12), respectively having base end portions 2AB and 2BB formed protruding outward in a width direction from the base member 1 (1A and 1B) and tip end portions 2AS and 2BS formed integral with the corresponding base end portions 2AB and 2BB and curved inward in the width direction so that the tip end portions 2AS and 2BS located facing each other in the width direction are movable between a binding position (see FIG. 1) where they contact each other and an open position (see FIG. 2) where they are separated by a predetermined distance. Each part or member of the binding tool 10 is made of synthetic resin such as polycarbonate (PC) and ABS resin, but also may be made of metal such as aluminum alloy.

The binding member 2 (2A, 2B) including the first binding members 2A (2A1 to 2A12) and the second binding members 2B (2B1 to 2B12) is configured such that, in the binding position, the tip end portions 2AS and 2BS and the base end portions 2AB and 2BB, located facing each other in the width direction, form a loop shape continuous via the base member 1 (1A and 1B). The loop shape formed by the tip end portions 2AS and 2BS and the base end portions 2AB and 2BB is nearly uniform in any cross-section. Further, the loop shape formed by the tip end portions 2AS and 2BS and the base end portions 2AB and 2BB may be a nearly circular ring shape as shown in FIG. 3 or a nearly angular ring shape as shown in FIG. 5. In FIG. 1, the first binding members 2A (2A1 to 2A12) and the second binding members 2B (2B1 to 2B12) are assigned reference numbers increasing from a front end to a rear end in the longitudinal direction of the binding tool 10.

When the tip end portions 2AS and 2BS located facing each other in the width direction are placed in contact with each other in the binding position, the base end portions 2AB and 2BB respectively integral with the tip end portions 2AS and 2BS are positionally displaced from each other in the longitudinal direction by an amount corresponding to at least the thickness TH of a base end portion (see FIGS. 5 and 6). To this amount of positional displacement between the base end portions 2AB and 2BB, any amount is theoretically applicable only if it is within a minimum pitch P1 (see FIG. 1) in the longitudinal direction of the first binding member 2A and the second binding member 2B. However, it is preferable to determine the amount in a range that does not cause deformation or the like of held papers SP (e.g., up to about twice the thickness TH of a base end portion).

Furthermore, the first binding members 2A (2A1 to 2A12) and the second binding members 2B (2B1 to 2B12) are designed such that each pitch P2 on the central side in the longitudinal direction is wider than each pitch P1 on the front end side and the rear end side and also the binding members 2A and 2B are arranged symmetrically on the front end side and the rear end side with respect to a center line CT in the longitudinal direction (see FIG. 1). As shown in FIG. 6, moreover, each first binding member 2A (2A1 to 2A12) and each second binding member 2B (2B1 to 2B12) are provided respectively with arc-shaped inner surfaces 2ABQ and 2BBQ which will contact binding holes WH formed in papers. The arc-shaped inner surfaces 2ABQ and 2BBQ of the base end portions 2AB and 2BB are located more outside than outer end faces of the base member 1 (1A and 1B) in the width direction.

In the binding position, the tip end portions 2AS of the first binding members 2A and the tip end portions 2BS of the second binding members 2B, located facing each other in the width direction, are joined (in contact) at a slant with a predetermined angle with respect to the longitudinal direction. The tip end portions 2AS and 2BS in a joined (contact) state provide an almost uniform thickness in the longitudinal direction. The first binding member 2A and the second binding member 2B located facing each other in the width direction can be smoothly coupled through the tip end portions 2AS and 2BS joined at the predetermined angle with respect to the longitudinal direction in the binding position while keeping almost constant the aforementioned positional displacement in the longitudinal direction between the base end portions 2AB and 2BB with the pitches P1 and P2 in the longitudinal direction of the first binding member 2A and the second binding member 2B.

The tip end portion 2AS of the first binding member 2A and the tip end portion 2BS of the second binding member 2B facing each other in the width direction each extend to taper off to a distal end in the width direction. Each of the tapering tip end portions 2AS and 2BS is provided with a contact surface TS perpendicular to the longitudinal direction. This configuration allows the tip end portions 2AS and 2BS to overlap each other over a large area in the width direction through their contact surfaces TS. The "contact surface(s) TS perpendicular to the longitudinal direction" may include not only a surface completely perpendicular to the longitudinal direction but also a surface slanted at an angle of about 5 to 10 degrees with respect to the perpendicular plane.

The base member 1 (1A and 1B) includes the first base member 1A formed with the first binding members 2A (2A1 to 2A12) and the second base member 1B formed with the second binding members 2B (2B1 to 2B12). The first base member 1A and the second base member 1B are configured to overlap one on the other in an up-down direction perpendicular to the longitudinal direction in the binding position. The first base member 1A and the second base member 1B are coupled to be movable in parallel in the width direction through a plurality of (herein, two sets of) link arm members 3 (3A, 3B). The plurality of (herein, two sets of) link arm members 3 (3A, 3B) are designed to have almost the same arm length.

To be concrete, as shown in FIGS. 3 and 4, the first base member 1A and the second base member 1B are formed in a multi-layer (two-layer) structure respectively having a plurality of (herein, two) nearly plate-like parts 1A1 and 1A2 and a plurality of (herein, two) nearly plate-like parts 1B1 and 1B2, each extending in the longitudinal direction, so that they are laminated one on the other to provide clearances 1A3 or 1B3. This multi-layer (two-layer) structure may be formed by integral molding or by bonding separate parts. The clearances 1A3 in the first base member 1A are provided in more than one position in the longitudinal direction between the upper-layer plate-like part 1A1 and the lower-layer plate-like part 1A2. Similarly, the clearances 1B3 in the second base member 1B are provided in more than one position in the longitudinal direction between the upper-layer plate-like part 1B1 and the lower-layer plate-like part 1B2. In the binding position, the link arm members 3 (3A, 3B) can be retracted, or housed, into the clearances 1A3 and 1B3. It should be noted that some of the clearances 1A3 of the first base member 1A, in which the link arm members 3 (3A, 3B) are not housed, are configured to receive the lower plate-like parts 1B2 of the second base member 1B, and also some of the clearances 1B3 of the second base member 1B, in which the link arm members 3 (3A, 3B) are not housed, are configured to receive the lower plate-like parts 1A2 of the first base member 1A.

Furthermore, as shown in FIGS. 7 and 8, each link arm member 3 (3A, 3B) is configured such that a first arm element 32 and a second arm element 33, each of which has a nearly rectangular plate-like shape extending in a longitudinal direction, are coupled stepwise to each other. The first arm element 32 is formed, on its rear end side (a left side in FIGS. 7 and 8), with a rotary shaft 31 protruding upward. The second arm element 33 is formed, on its front end side (a right side in FIGS. 7 and 8), with a rotary shaft 34 protruding downward. The first arm element 32 and the second arm element 33 are arranged in parallel in the longitudinal direction and also symmetrically and eccentrically in the width direction with respect to the center line joining the rotary shafts 31 and 34.

As shown in FIGS. 9 and 10, the rotary shaft 31 of the first arm element 32 is fitted in a shaft hole 1AP formed at the center of the plate-like part 1A1 in the width direction, located in the upper layer of the first base member 1A, while the rotary shaft 34 of the second arm element 33 is fitted in a shaft hole 1BP formed at the center of the plate-like part 1B2 in the width direction, located in the lower layer of the second base member 1B. Accordingly, in the binding position, the first arm element 32 is held in the clearance 1A3 in the first base member 1A and the second arm element 33 is held in the clearance 1B3 in the second base member 1B. In the binding position, the link arm members 3 (3A, 3B) do not protrude outward in the width direction from side end faces of the first base member 1A and the second base member 1B.

As shown in FIGS. 3, 4, 11, and 12, the first base member 1A and the second base member 1B are formed with engagement portions 1A21, 1B21, and 1A22, each of which protrudes in the up-down direction, in positions where the base members overlap one in the other in a central part, a front end part, and a rear end part in the longitudinal direction.

To be concrete, as shown in FIG. 11, in the central part (herein, three places) of the first base member 1A and the second base member 1B in the longitudinal direction, there are provided the engagement portion 1A21 protruding downward from the lower-layer plate-like part 1A2 of the first base member 1A, and the engagement portion 1B21 protruding upward from the lower-layer plate-like part 1B2 of the second base member 1B, so that the engagement portions 1A21 and 1B21 engage with each other in the binding position. The engagement portions 1A21 and 1B21 come into engagement with each other when the lower-layer plate-like part 1A2 of the first base member 1A is laterally inserted into the clearance 1B3 formed between the upper-layer plate-like part 1B1 and the lower-layer plate-like part 1B2 of the second base member 1B. The engagement portions 1A21 and 1B21 respectively formed in the central parts of the first base member 1A and the second base member 1B in the longitudinal direction may be not necessarily provided if the first base member 1A and the second base member 1B are short in length in the longitudinal direction (for instance, when it is applied to a small-sized notebook such as a B5 or smaller notebook).

As shown in FIGS. 3, 4, and 12, in the front end part and the rear end part of the first base member 1A and the second base member 1B in the longitudinal direction, the upper-layer plate-like part 1B1 and the lower-layer plate-like part 1B2 of the second base member 1B extend in the longitudinal direction in a cantilever beam form, so that the lower-layer plate-like part 1A2 of the first base member 1A can be inserted in the clearance 1B3 between the plate-like parts 1B1 and 1B2. Further, the protruding downward engagement portion 1A22 formed in the lower-layer plate-like part 1A2 of the first base member 1A is formed to be engageable with a cutout 1B22 formed in the lower-layer plate-like part 1B2 of the second base member 1B in the binding position. The engagement portion 1A22 and the cutout 1B22 also come into engagement with each other when the lower-layer plate-like part 1A2 of the first base member 1A is laterally inserted into the clearance 1B3 formed between the upper-layer plate-like part 1B1 and the lower-layer plate-like part 1B2 of the second base member 1B. It should be noted that the engagement portion 1A22 and the cutout 1B22 may also be provided in either of the first base member 1A and the second base member 1B and further may be provided only in one of the front end part and the rear end part in the longitudinal direction.

Moreover, as shown in FIGS. 3 and 4, the upper-layer plate-like part 1A1 of the first base member 1A is formed with the base end portions 2AB protruding outward in the width direction and also recesses 1A5 recessed inward in the width direction and arranged at positions adjacent to and more rear than the corresponding base end portions 2AB in the longitudinal direction. The upper-layer plate-like part 1B1 of the second base member 1B is formed with the base end portions 2BB protruding outward in the width direction and also recesses 1B5 recessed inward in the width direction and arranged at positions adjacent to and more front than the corresponding base end portions 2BB in the longitudinal direction. The recesses 1A5 and 1B5 are provided as mentioned later to avoid interference between the base end portions 2AB of the first binding members 2A protruding in the width direction and the upper-layer plate-like part 1B1 of the second base member 1B of an adjacent file 20 and interference between the base end portions 2BB of the second binding members 2B protruding in the width direction and the upper-layer plate-like part 1A1 of the first base member 1A of another adjacent file 20 when the files 20 holding papers set in the binding tool 10 are stored on a bookshelf and the like such that the longitudinal direction of each spine 4C mounted on each base member 1 (1B) is upright (see FIG. 15).

<Structure of File>

Figure 13:
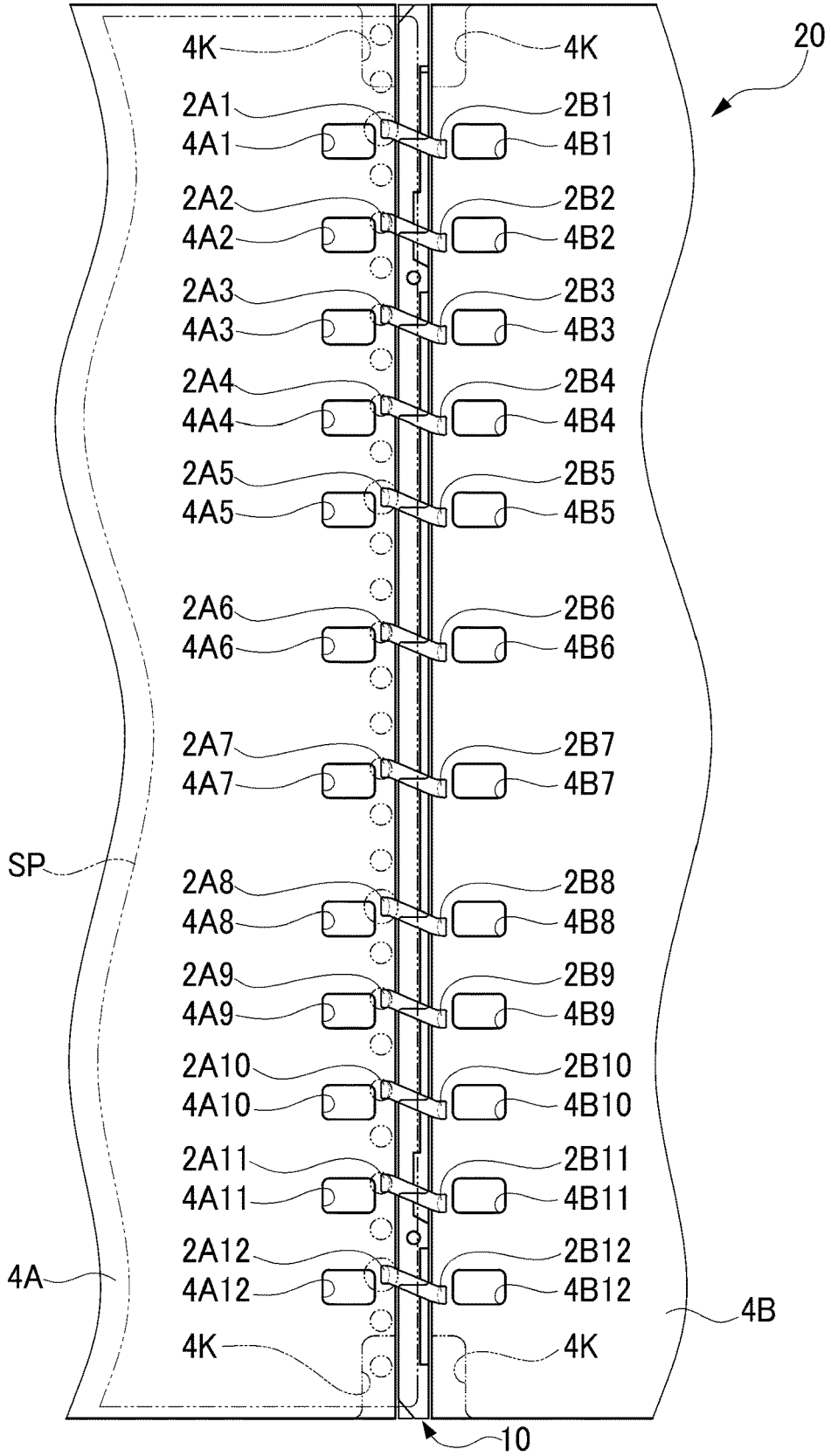
FIG. 13 is a plan view of a file in an open state (a front cover and a back cover are opened) in a second embodiment of the present invention.
Figure 14:
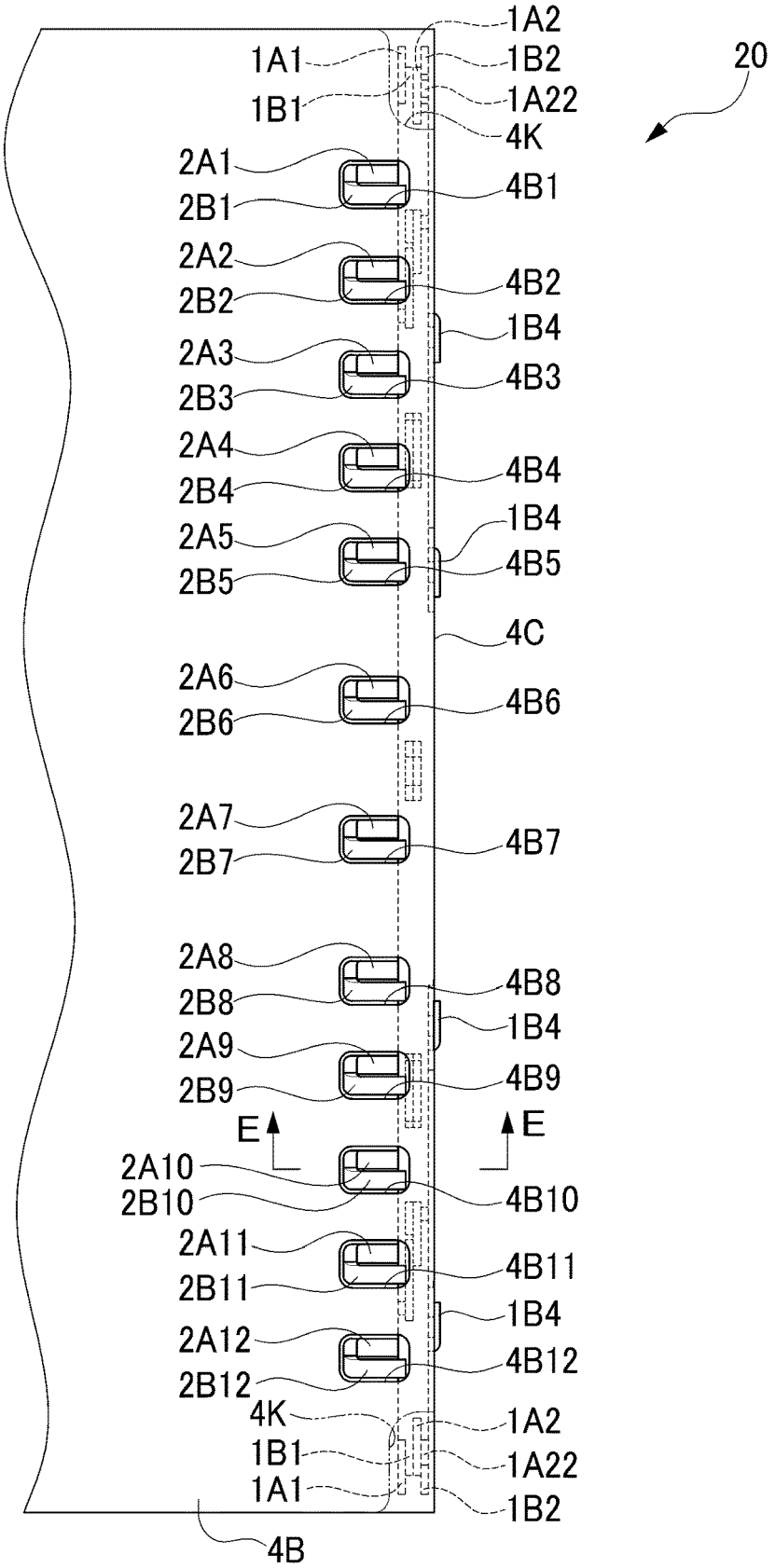
FIG. 14 is a side view of the file shown in FIG. 13, in a closed state (the front cover and the back cover are closed)
Figure 15:
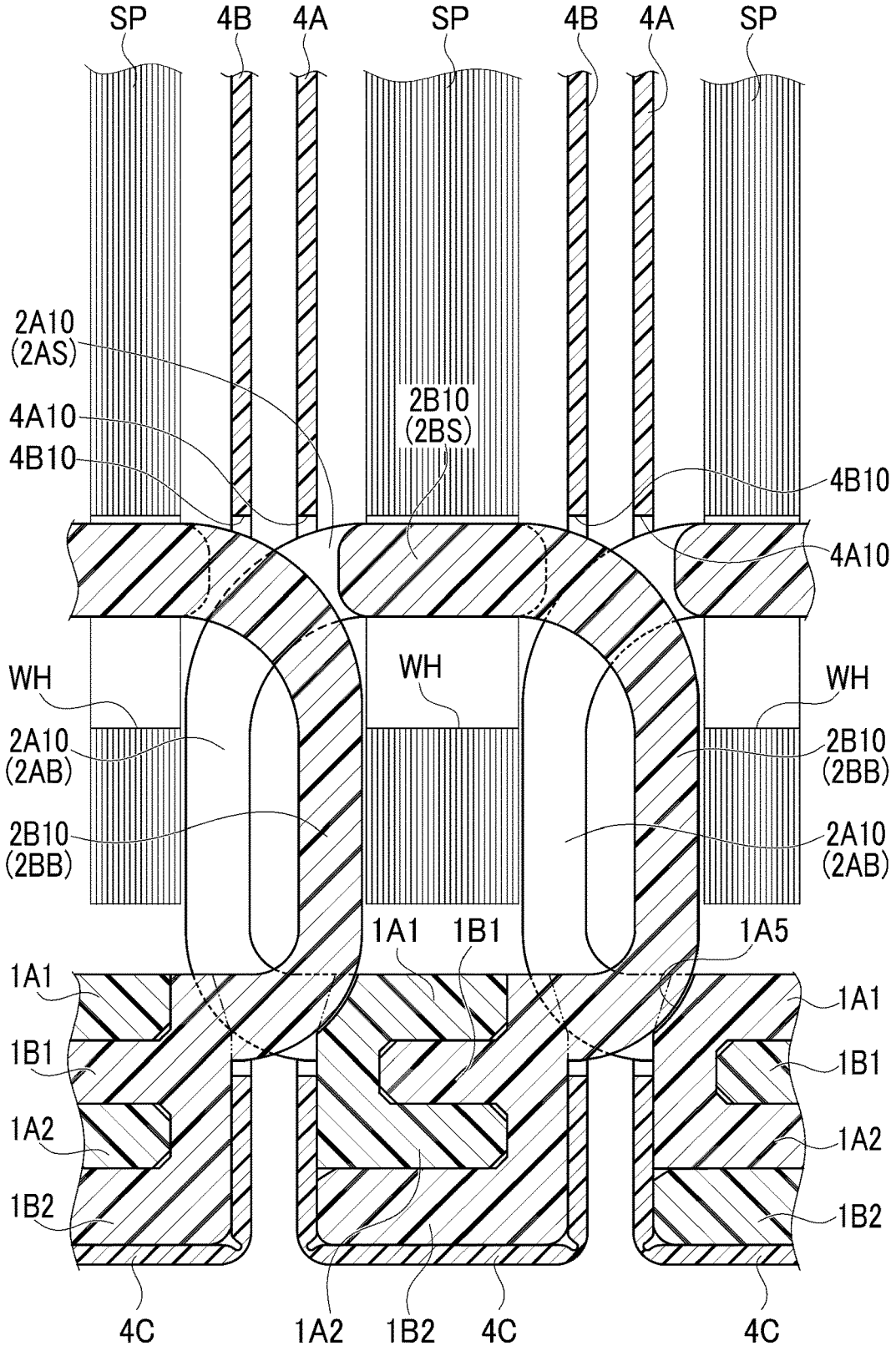
FIG. 15 is a cross-sectional view of a plurality of files taken along a line E-E in FIG. 14, in which the files, each holding papers through a binding tool, are arranged such that a longitudinal direction of each spline of the files is upright and the files overlap an adjacent file.
Figure 16:
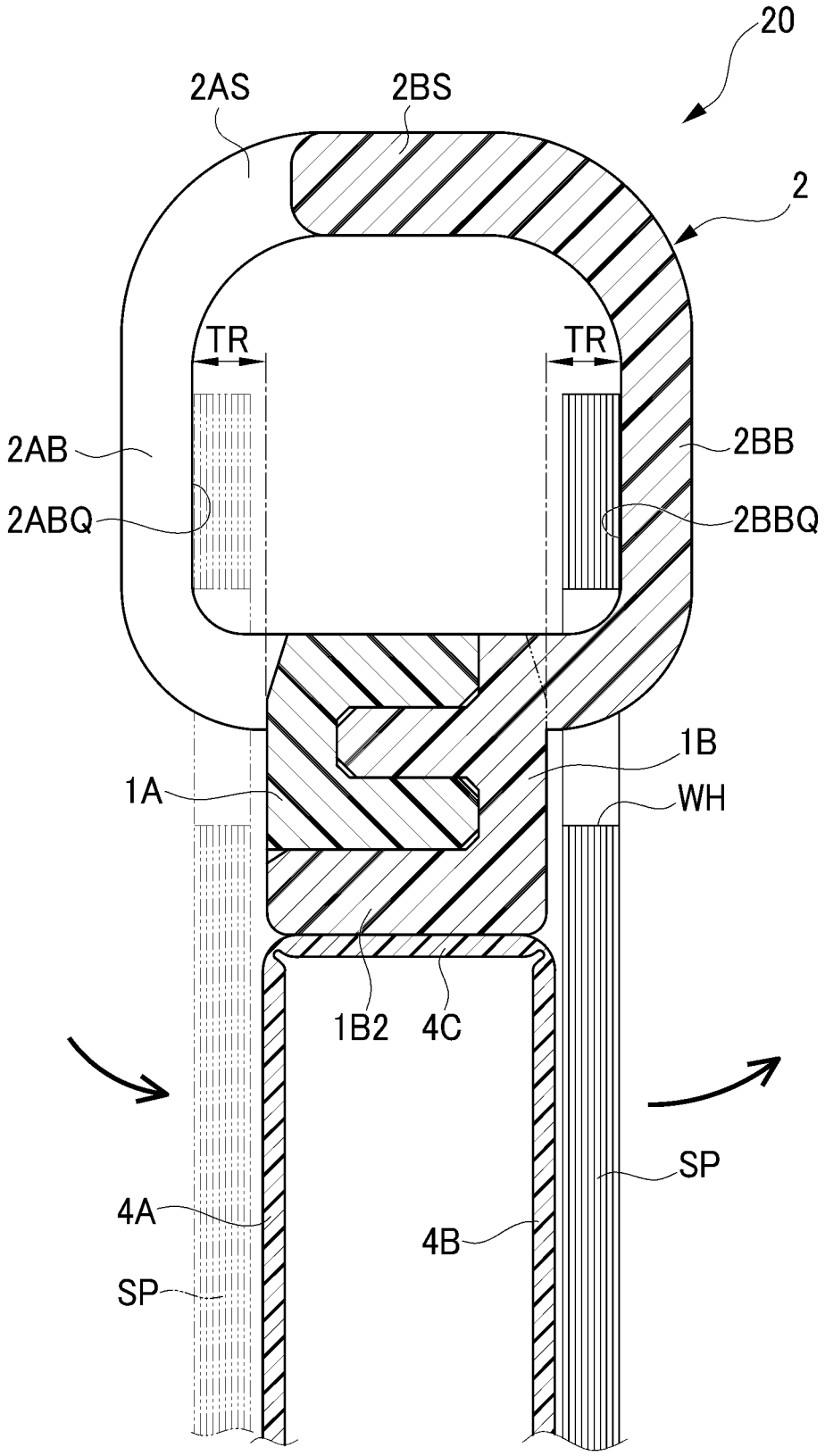
FIG. 16 is a cross-sectional view of the file of FIG. 14, after turning the front cover or the back cover by 180° together with papers.
Figure 17:
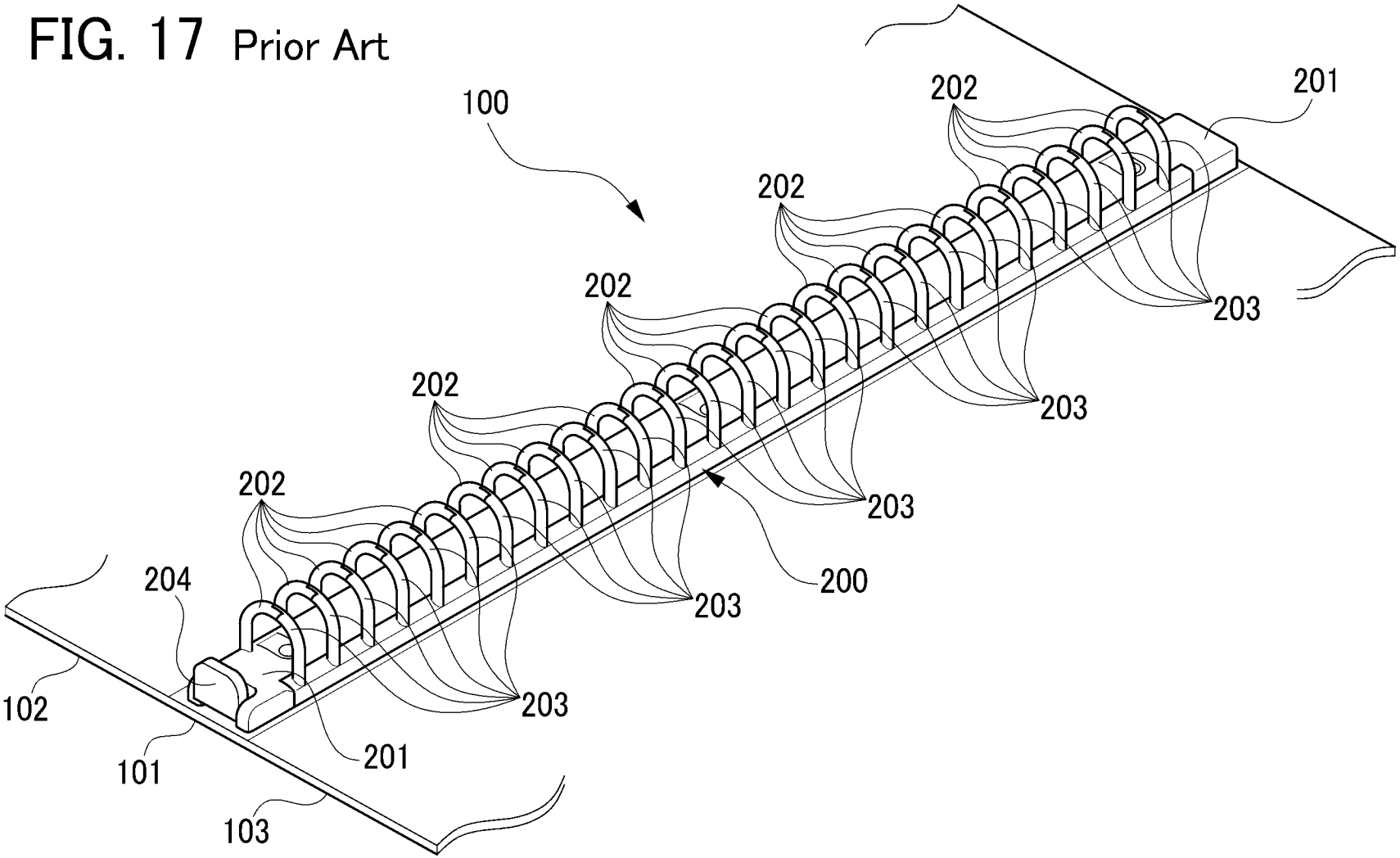
FIG. 17 Prior Art
FIG. 17 is a perspective view of a file provided with a binding tool disclosed in Patent Document 1.
Figure 18:
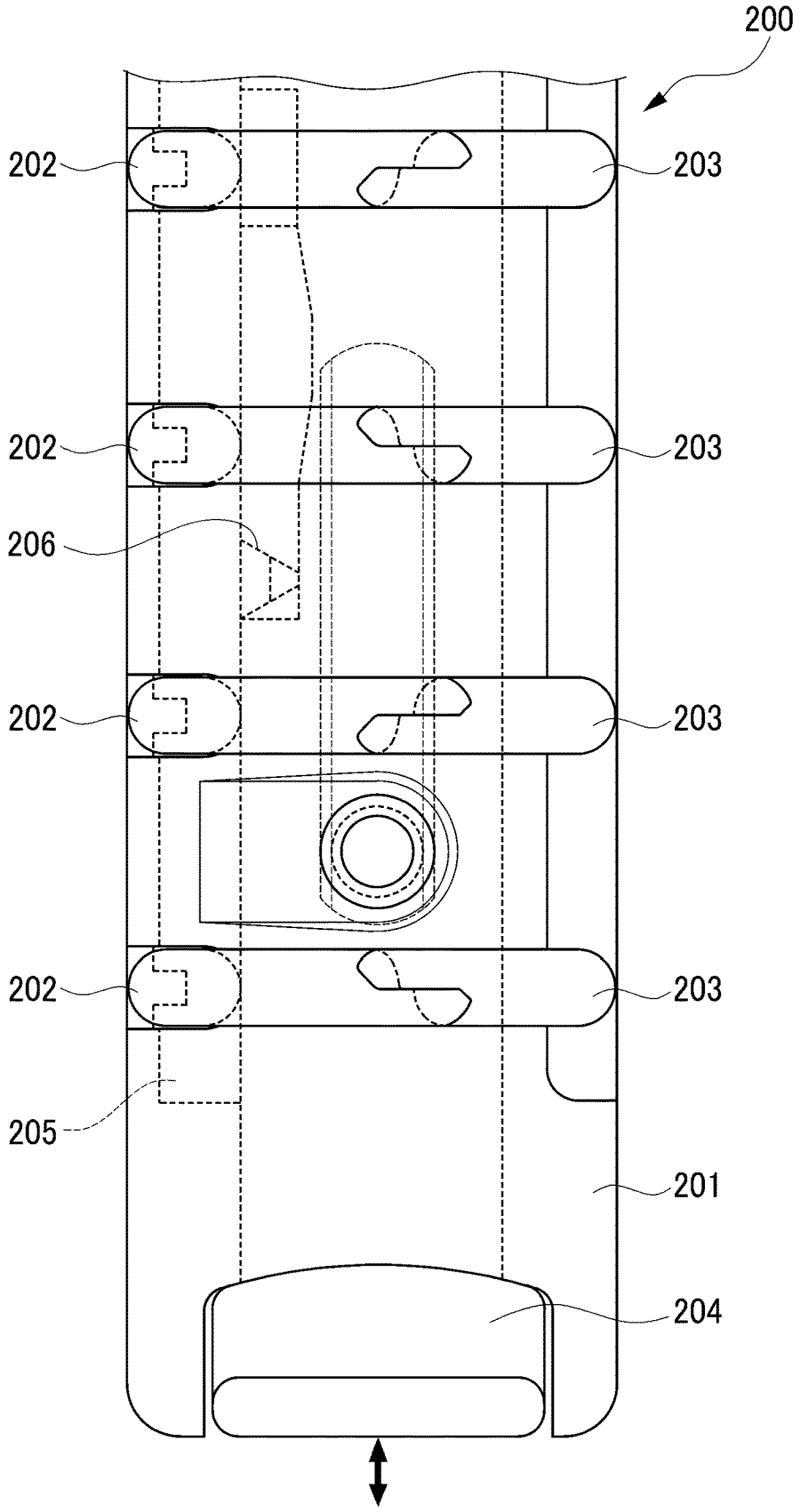
FIG. 18 Prior Art
FIG. 18 is a partial plan view of the binding tool shown in FIG. 17.

The structure of a file in a second embodiment of the invention, provided with the aforementioned binding tool, will be described below referring to FIGS. 13 to 16. FIG. 13 is a plan view of the file in an open or spread state (a front cover and a back cover are opened) in the second embodiment of the invention. FIG. 14 is a side view of the file shown in FIG. 13, in a closed state (the front cover and the back cover are closed). FIG. 15 is a cross-sectional view of a plurality of files taken along a line E-E in FIG. 14, in which the files each holding papers with a binding tool are stored such that the files with a longitudinal direction of each spine of the files upright overlap an adjacent file or files, that is, are closely arranged side by side. FIG. 16 is a cross-sectional view of the file of FIG. 14, after turning the front cover or the back cover by 180° together with papers.

As shown in FIGS. 13 to 16, each file 20 in this embodiment is provided with the aforementioned binding tool 10, the spine 4C mounted with the binding tool 10 extending in the longitudinal direction, and a front cover 4A and a back cover 4B continuous with each other through the spine 4C. The front cover 4A and the back cover 4B are provided respectively with nearly-rectangular insertion holes 4A1 to 4A12 and 4B1 and 4B12, in each of which the base end portions 2AB of the first binding members 2A (2A1 to 2A12) and the base end portions 2BB of the second binding members 2B (2B1 to 2B12) can be inserted in pairs, i.e., two in each hole, side by side in the longitudinal direction.

Accordingly, when the plurality of files 20 are stored on a bookshelf and the like such that the files 20 with the longitudinal direction of each spine 4C upright overlap, or contact, an adjacent one(s), the base end portions 2AB of the first binding members 2A of one file 20 and the base end portions 2BB of the second binding members 2B of an adjacent file 20 can be inserted in pairs, i.e., two in in each of the insertion holes 4A1 to 4A12 and 4B1 to 4B12. At that time, as shown in FIG. 15, the binding tools 10 can be placed close to each other in the width direction, unless they are restricted by the width of each base member 1, until the base end portions 2AB of the first binding members 2A and the base end portions 2BB of the second binding members 2B directly contact the papers SP having a predetermined volume (thickness) held by the adjacent binding tools 10.

Furthermore, the first binding members 2A and the second binding members 2B are arranged such that each pitch P2 on the central side in the longitudinal direction is wider than each pitch P1 on the front end side and the rear end side and further arranged symmetrically on the front end side and the rear end side with respect to the center line CT in the longitudinal direction. For example, each pitch P1 is set to be twice a hole pitch of binding holes WH formed in a commercially available A4-sized 30-hole notebook leaf and each pitch P2 is set to be triple the hole pitch of the same 30-hole notebook leaf, as shown in FIG. 13. Accordingly, it is advantageous that commercially available A4-sized notebook leaves can be directly used. Further, the insertion holes 4A1 to 4A12 formed in the front cover 4A and the insertion holes 4B1 to 4B12 formed in the back cover 4B are not continuous with each other.

The spine 4C, the front cover 4A, and the back cover 4B may be provided with a cutout for operation ("operating cutout") 4K formed to allow operation of the front end part and the rear end part of the binding tool 10 in the longitudinal direction. The operating cutout 4K is preferably formed in a nearly U-like or nearly V-like shape with a size enough to allow user's finger(s) to enter therein while the file 20 is in an open state. In this case, a user is allowed to pinch an end portion of the upper-layer plate-like part 1A1 of the first base member 1A and an end portion of the lower-layer plate-like part 1B2 of the second base member 1B and separate them upward and downward, thereby easily releasing the engagement between the engagement portion 1A22 and the cutout 1B22. In the case where the engagement portions 1A22 and the cutouts 1B22 are provided in the first base member 1A and the second base member 1B in their front end parts and rear end parts in the longitudinal direction, the operating cutout 4K has only to be formed in correspondence to the front end parts or the rear end parts in which the engagement portions 1A22 and the cutouts 1B22 are formed.

The base member 1 (1B) is provided with flanged locking portions 1B4 engageable with locking holes formed in the spine 4C. Each of the flanged locking portions 1B4 includes a base portion 1B41 protruding downward from a lower surface of the second base member 1B and flanges 1B42 extending backward and frontward from the base portion 1B41. By moving the spine 4C in the longitudinal direction, the locking holes of the spine 4C are inserted one into each of the clearances formed between the flanges 1B42 and the second base member 1B. Each flange 1B42 is flat and thin, resulting in a reduced protruding amount from the spine 4C.

In the file 20 in the present embodiment, the inner surface 2ABQ of the base end portion 2AB and the inner surface 2BBQ of the base end portion 2BB of each of the binding members 2 (2A, 2B) are designed to be located more outside than the outer end faces of the base member 1 (1A and 1B) by a predetermined distance TR. Accordingly, as shown in FIG. 16, as long as the thickness of the papers SP held by the binding members 2 (2A, 2B) is equal to or less than the protruding distance TR, the papers SP can be flipped, or turned 180°, while maintaining its flat state, together with the back cover 4B or the front cover 4A. Furthermore, the papers SP having been turned 180° may be further turned back 360° while remaining held in the binding members 2

(2A, 2B). In this case, it is easy to write necessary characters or figures on the flat paper SP turned 180° or 360° by holding the file 20 with the size corresponding to a closed state. This can enhance the convenience of the file 20 as e.g. a sketchbook or the like with papers SP having a large planar size and a large paper thickness.

<Operations and Advantageous Effects>

As described in detail above, according to the binding tool 10 in the present embodiment of the invention, when the tip end portions 2AS and 2BS located facing each other in the width direction are in contact with each other in the binding position, the base end portions 2AB and 2BB integral with the corresponding tip end portions 2AS and 2BS are positionally displaced in the longitudinal direction by at least an amount corresponding to the thickness TH of the base end portion. Accordingly, when the binding tools 10 of the adjacent files 20 are placed close to each other in the width direction, it is possible to prevent the base end portions 2AB of the first binding member 2A and the base end portions 2BB of the second binding member 2B, protruding in the width direction of each base member 1 (1A and 1B), from interfering with those of adjacent base members 1.

Consequently, the binding tools 10 can be placed close to each other in the width direction, unless they are restricted by the width of each base member 1, until the base end portions 2AB of the first binding members 2A and the base end portions 2BB of the second binding members 2B directly contact the papers SP having a predetermined volume (thickness) held by the adjacent binding tools 10. Thus, the present embodiment can provide the binding tools 10 compact in the width direction in the binding position, so that when the files 20 with the binding tools 10 mounted on the corresponding spines 4C are stored with the longitudinal direction of each spine 4C upright on a bookshelf and the like, the files can overlap, or contact, an adjacent one(s), resulting in an increase in the number of files to be stored.

According to the present embodiment, the tip end portions 2AS of the first binding members 2A and the tip end portions 2BS of the second binding members 2B, located facing each other in the width direction, are joined to each other at a slant with a predetermined angle to the longitudinal direction in the binding position. Thus, the first binding member 2A and the second binding member 2B can be smoothly coupled through the tip end portions 2AS and 2BS while keeping almost constant the positional displacement in the longitudinal direction between the base end portions 2AB of the first binding members 2A and the corresponding base end portions 2BB of the second binding members 2B with the pitches of the first binding members 2A and the second binding members 2B. This can prevent deformation and the like of the held papers. Thus, the binding tool 10 can compact in the width direction in the binding position while easily preventing deformation and the like of the papers held therein.

According to the present embodiment, the tip end portions 2AS of the first binding members 2A and the tip end portions 2BS of the second binding members 2B, located facing each other in the width direction, each extend to taper off to a distal end in the width direction. Each of the tapering tip end portions 2AS and 2BS is provided with the contact surface TS perpendicular to the longitudinal direction. This configuration allows the tip end portions 2AS and 2BS in the binding position to overlap each other over a large area in the width direction through their contact surfaces TS. Thus, with the contact surfaces TS allowing a large overlapping area in the width direction, even the binding tool 10 compact in the width direction in the binding position and flexible in the width direction can easily prevent a paper(s) SP from coming off or slipping out.

According to the present embodiment, furthermore, the base member 1 includes the first base member 1A formed with the first binding members 2A and the second base member 1B formed with the second binding member 2B. Since the first base member 1A and the second base member 1B are assembled so as to overlap one on another in the up-down direction perpendicular to the longitudinal direction in the binding position, the first base member 1A and the second base member 1B can be configured to be wide in width to ensure respective strength, but can reduce the total width of the base member 1 in the binding position by an amount of overlapping in the up-down direction. This can achieve a further reduced-width of the base member 1 in the binding position. Since the first base member 1A and the second base member 1B overlap each other, or stacked, in the up-down direction perpendicular to the longitudinal direction in the binding position, it is also possible to reduce warping or bending of the first base member 1A and the second base member 1B in the up-down direction. Thus, the binding tool more compact in the width direction in the binding position can be provided while ensuring the necessary strength of the first base member 1A and the second base member 1B in the binding position.

According to the present embodiment, the first base member 1A and the second base member 1B are formed with the engagement portions 1A21, 1B21, and 1A22, each of which protrudes in the up-down direction, in the central prat, front end part, and rear end part in which the base members overlap one on another. The first base member 1A and the second base member 1B extending in the longitudinal direction can be reliably locked with each other in the binding position without designing the engagement portions 1A21, 1B21, and 1A22 so as to protrude in the width direction. This can provide the binding tool 10 more compact in the width direction in the binding position while reliably realizing the locked state of the first base member 1A and the second base member 1B in the binding position.

Figure 19:
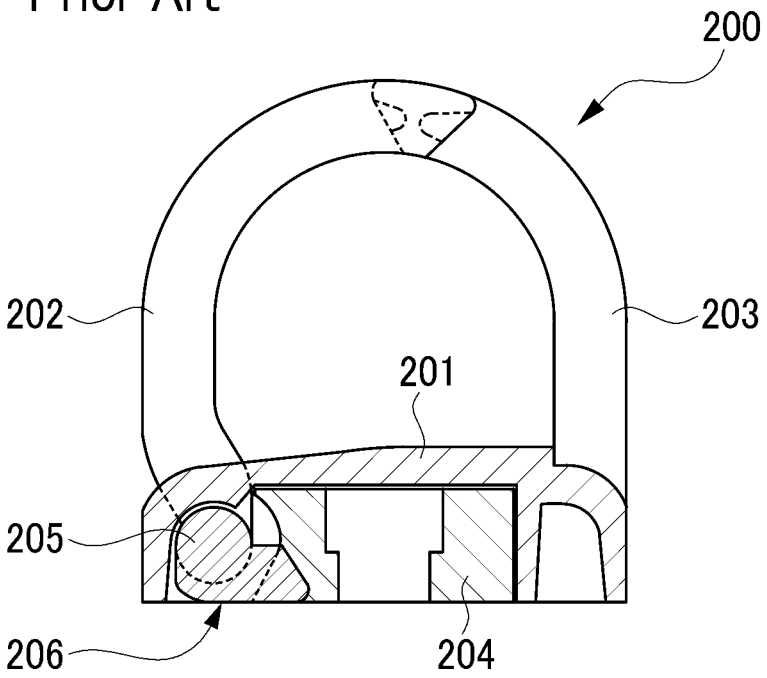
FIG. 19 Prior Art
FIG. 19 is a cross-sectional view of the binding tool shown in FIG. 17, the binding tool being in a binding position.
Figure 20:
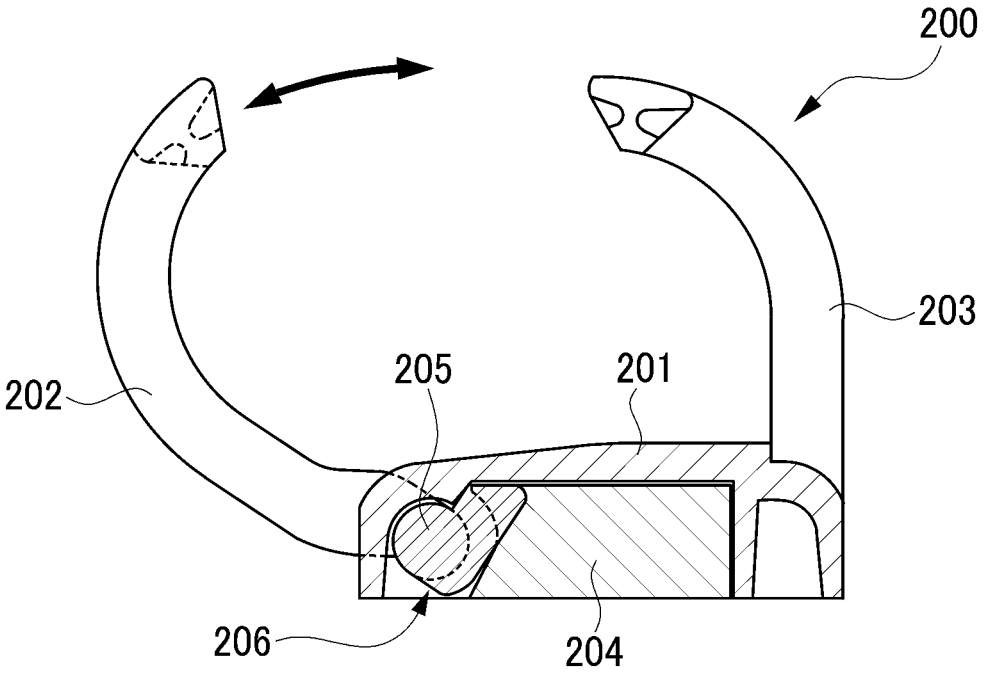
FIG. 20 Prior Art
FIG. 20 is a cross-sectional view of the binding tool shown in FIG. 17, the binding tool being in an open position.
Figure 21:
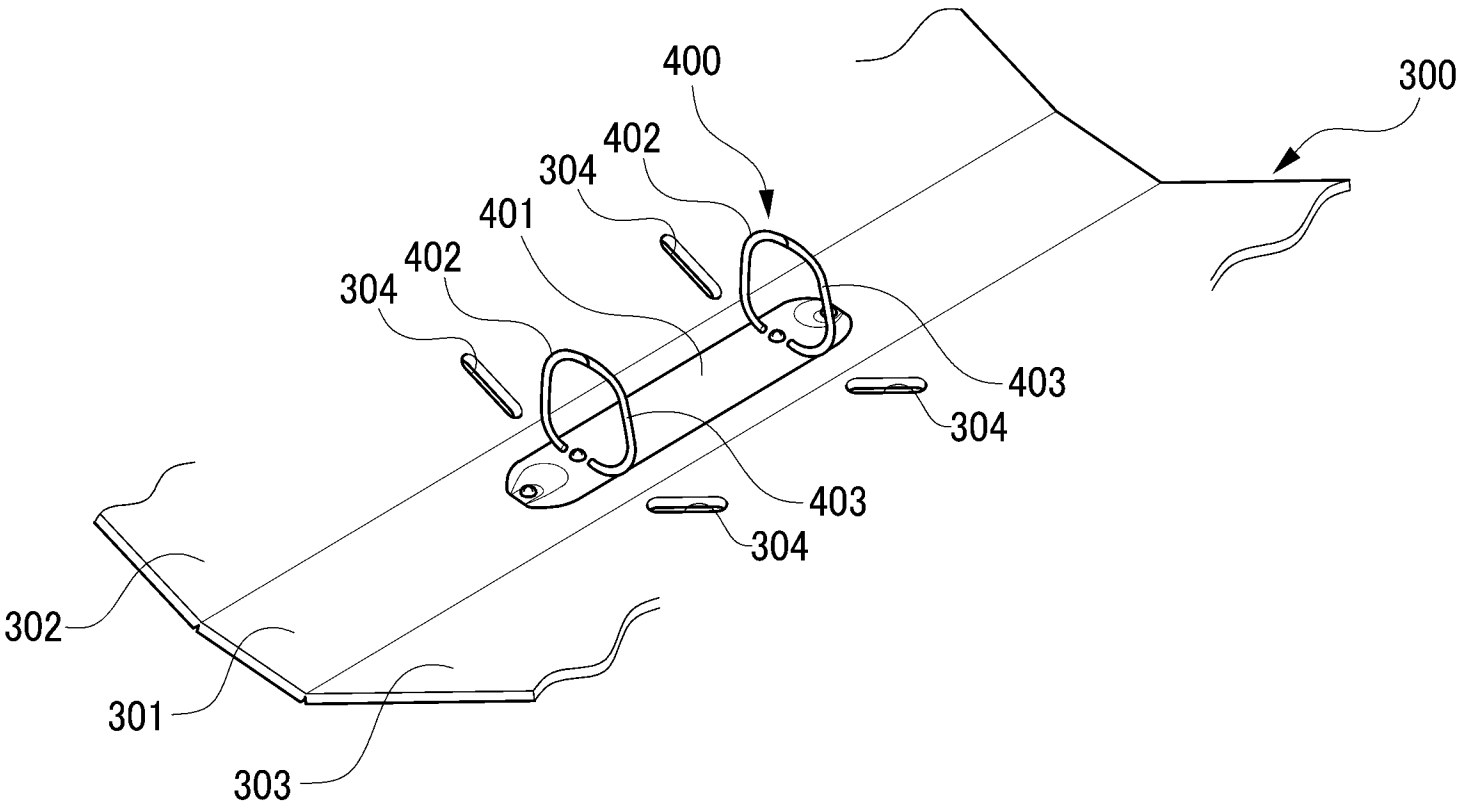
FIG. 21 Prior Art
FIG. 21 is a perspective view of a file provided with a binding tool disclosed in Patent Document 2.

According to the present embodiment, the first base member 1A and the second base member 1B are coupled to be movable in the width direction through the plurality of link arm members 3 (3A and 3B), so that the first base member 1A and the second base member 1B and the link arm members 3 can be placed in nearly parallel with each other in the longitudinal direction in the binding position. Furthermore, when the first base member 1A and the second base member 1B are moved in the width direction between the binding position and the open position, the first base member 1A and the second base member 1B are applied with only a rotation frictional force through the rotary shafts 31 and the rotary shafts 34 supporting the link arm members 3. Thus, the structures of the first base member 1A and the second base member 1B and the link arm members 3 can be simplified, resulting in further reduction in the width of the binding tool 10. Since the first base member 1A and the second base member 1B are moved in the width direction through the link arm members 3 (3A and 3B), furthermore, the clearances can be wide when the binding members are in the open position. This can solve the problem that the clearances are narrow when the binding members are in the closed position, causing papers to be caught, as shown by the movable-side binding member 202 (see FIG. 19) which rotates about the rotary shaft 205 placed in the conventional base member 201.

According to the present embodiment, the first base member 1A and the second base member 1B are assembled to form a multi-layer structure in which a plurality of plate-like parts 1A1, 1A2, 1B1, and 1B2 each extending in the longitudinal direction are stacked in the up-down direction while forming the clearances 1A3 and 1B3 therebetween. Each link arm member 3 (3A and 3B) can be housed in the clearances 1A3 and 1B3 in the binding position. Therefore, in the binding position, any influence of the width of each link arm member 3 (3A and 3B) on the width of the binding tool 10 is negligible. Thus, the binding tool 10 can have a more reduced width in the binding position.

According to the present embodiment, each link arm member 3 (3A and 3B) is configured such that the first arm element 32 to be housed in the clearance 1A3 of the first base member 1A and the second arm element 33 to be housed the clearance 1B3 of the second base member 1B in the binding position are coupled stepwise at a link middle portion 35. Thus, the size of the clearance 1A3 of the first base member 1A in the longitudinal direction for housing the link arm member 3 and the size of the clearance 1B3 of the second base member 1B in the longitudinal direction for housing the link arm member 3 can be set to be small at the same level as each other. This makes it possible to prevent degradation of strength of the first base member 1A and the second base member 1B due to the clearances 1A3 and 1B3 in a balanced manner. Accordingly, the strength degradation of the base member 1 due to retaining of the link arm member 3 can be prevented and also the binding tool 10 can be configured more compact in width.

According to the file 20 in the second embodiment of the invention, the front cover 4A and the back cover 4B are respectively provided with the insertion holes 4A1 to 4A12 and 4B1 to 4B12 in each of which the base end portions 2AB of the first binding members 2A and the base end portions 2BB the second binding members 2B can be inserted, two in each hole, side by side in the longitudinal direction. Accordingly, when the plurality of files 20 are stored with the longitudinal direction of each spine 4C upright so that the files 20 overlap, or contact, an adjacent one(s), on a bookshelf and the like, the base end portions 2AB of the first binding members 2A of one file 20 and the base end portions 2BB of the second binding members 2B of an adjacent file 20 can be inserted in pairs, i.e., two in each corresponding insertion hole 4A1 to 4A12 and 4B1 to 4B12. Thus, the binding tools 10 can be placed close to each other in the width direction, unless they are restricted by the width of each base member 1, until the base end portions 2AB of the first binding members 2A and the base end portions 2BB of the second binding members 2B directly contact the papers SP having a predetermined volume (thickness) held by the adjacent binding tools 10.

Consequently, the present embodiment can provide the files 20 such that when the files 20 with the binding tools 10 holding papers are stored with the longitudinal direction of each spine 4C upright on a bookshelf and the like, the files 20 can overlap, or contact, an adjacent one(s) without interference of the front cover 4A and the back cover 4B with respect to the base end portions 2AB of the first binding members 2A and the base end portions 2BB of the second binding members 2B, each protruding in the width direction. This can result in an increase in the number of files to be stored.

According to the second embodiment of the invention, the spine 4C, the front cover 4A, and the back cover 4B are provided with the operating cutouts 4K to allow operation of the front end part and the rear end part of the binding tool 10 in the longitudinal direction. Thus, a user is allowed to pinch an end portion of the upper-layer plate-like part 1A1 of the first base member 1A and an end portion of the lower-layer plate-like part 1B2 of the second base member 1B and separate them upward and downward, thereby easily releasing the engagement between the engagement portion 1A22 and the cutout 1B22. Therefore, the file 20 provided with the binding tool 10 compact in the width direction can also realize a file easy to operate.

According to the second embodiment of the invention, the base member 1 (1B) is provided with the flanged locking portions 1B4 engageable with the locking holes formed in the spine 4C. Thus, any additional means for fixing the spine 4C to the base member 1, for example, a rivet, a screw, or the like, are unnecessary. Accordingly, the base member 1 (1B) can be configured more compact, enabling the files 20 to be stored closely, overlapping an adjacent one(s), on a bookshelf and the like, resulting in an increase in the number of files to be stored.

According to the second embodiment of the invention, the first binding members 2A and the second binding members 2B are arranged with pitches so that each pitch P2 on the central side in the longitudinal direction is wider than each pitch P1 on the front end side and the rear end side in the longitudinal direction and also arranged symmetrically on the front end side and the rear end side in the longitudinal direction. When a paper(s) SP is to be released from the binding tool 10 of the file 20, the paper(s) SP is usually detached from its front or rear end side in the longitudinal direction of the base member 1 (1A and 1B). Accordingly, the external force acting on the first binding members 2A and the second binding members 2B through the binding holes WH of the papers SP is apt to act on the front end side or the rear end side of the base member 1 (1A and 1B) but is less likely to act on the central side of the base member 1 (1A and 1B). Thus, the base member 1 (1A and 1B) on the central side required to have high strength can be simplified in structure, so that the entire base member 1 (1A and 1B) can be designed more compact in the width direction. This enables the files 20 to be stored closely, or overlap an adjacent one(s), on a bookshelf and the like, resulting in an increase in the number of files to be stored.

The first binding members 2A and the second binding members 2B are arranged so that each pitch P2 on the central side in the longitudinal direction is wider than each pitch P1 on the front end side and the rear end side in the longitudinal direction and also arranged symmetrically on the front side and the rear side in the longitudinal direction. This also makes it possible to reduce the number of binding holes WH needing to be formed in the papers SP which will be held by the binding tool 10 of the file 20, thereby avoiding jamming of the papers SP during printing. Furthermore, the number of binding holes WH to be formed in the papers SP after printing can also be reduced and thus processing equipment for making binding holes can be simplified. This can also achieve an advantage that, even when the paper(s) SP has a thin thickness, such a paper is less likely to be deformed, e.g., folded or bent, around each binding hole WH.

When each pitch P1 in the first binding members 2A and the second binding members 2B is set to be twice the pitch of binding holes WH formed in for example a commercially available A4-sized 30-hole notebook leaf and each pitch P2 is set to be triple the hole pitch of the binding holes WH of the same 30-hole notebook leaf, the notebook leaf may be put in a file so that the notebook leaf is turned upside down or inside out.

The aforementioned embodiments may be changed or modified without departing from the essential characteristics of the invention. For instance, the binding tool 10 in the aforementioned embodiment is configured such that the plurality of (herein, two) link arm members 3 (3A and 3B) have almost the same arm length and the first base member 1A and the second base member 1B are coupled to each other to be movable in parallel in the width direction through the plurality of (herein, two) link arm members 3 (3A and 3B). As an alternative, the coupling member is not limited thereto. For example, the link arm members may have different arm length in the longitudinal direction of the binding tool. Further, the first base member 1A and the second base member 1B may be coupled to each other, instead of using the link arm member, by using a linking pin on the front end part or the rear end part in the longitudinal direction to allow the base members to move in the width direction by rotation about the linking pin.

In the aforementioned embodiments, each of the first base member 1A and the second base member 1B is configured as a two-layer structure in which two plate-like parts 1A1 and 1A2 or two plate-like parts 1B1 and 1B2, each extending in the longitudinal direction, are stacked in the up-down direction with the clearance 1A3 or 1B3 formed therebetween. However, the layer structure is not limited thereto. For instance, the first base member 1A may consist of three plate-like parts each extending in the longitudinal direction and the second base member 1B may consist of two plate-like parts each extending in the longitudinal direction to form a three-layer structure and a two-layer structure, each including clearances in the up-down direction. In this case, the link arm members 3 may be connected in flat manner instead of stepwise manner.

In the aforementioned second embodiment, the file 20 is provided with the binding tool 10, the spine 4C on which the binding tool 10 is mounted extending in the longitudinal direction, and the front cover 4A and the back cover 4B continuous with each other via the spine 4C. However, the file does not always have to include a spine. For example, a file may be configured such that the front cover 4A and the back cover 4B are separated into two covers and locked respectively to the first binding members 2A (2A1 to 2A5, 2A8 to 2A12) and the second binding members 2B (2B1 to 2B5, 2B8 to 2B12) of the binding tool 10 through the insertion holes 4A1 to 4A12 formed in the front cover 4A and the insertion holes 4B1 to 4B12 formed in the back cover 4B. In this case, a label to be usually adhered to a spine may be adhered to an under surface of the base member 1 (1B).

INDUSTRIAL APPLICABILITY

The present invention is applicable as a binding tool capable of holding papers in an open state and a file provided with the binding tool.

REFERENCE SIGNS LIST

1A, 1 First base member (Base member)
1B, 1 Second base member (Base member)
1A1, 1A2 Plate-like part
1B1, 1B2 Plate-like part
1A21, 1A22 Engagement portion
1B21 Engagement portion
1A3, 1B3 Clearance
1B4 Flanged locking part
2A, 2 First binding member (Binding member)
2B, 2 Second binding member (Binding member)
2AB, 2BB Base end portion
2AS, 2BS Tip end portion
3A, 3B, 3 Link arm member
31, 34 Rotary shaft
32 First arm element
33 Second arm element
35 Link middle portion
4A Front cover
4B Back cover
4C Spine
4A1 to 4A12 Insertion hole
4B1 to 4B12 Insertion hole
4K Operating cutout
TH Thickness
TS Contact surface

The invention claimed is:

1. A binding tool for papers, the binding tool comprising:
a base member extending in a longitudinal direction; and
a plurality of first binding members and a plurality of second binding members, each of the plurality of first binding members and each of the plurality of second binding members having a base end portion protruding outward in a width direction of the base member and a tip end portion integral with the base end portion and curved inward in the width direction, the tip end portions being located facing each other in the width direction and being movable between a binding position in which the tip end portions are in contact with each other and an open position in which the tip end portions are separated by a predetermined distance, wherein:
when the tip end portions located facing each other in the width direction are in contact with each other in the binding position, the base end portions, which are integral with the corresponding tip end portions, are positionally displaced from each other in the longitudinal direction by at least an amount corresponding to a thickness of each base end portion, and
the base member includes a first base member formed with the first binding members and a second base member formed with the second binding members, and the first base member and the second base member are coupled to each other so as to be movable in the width direction between the binding position and the open position.

2. The binding tool according to claim 1, wherein the first base member and the second base member overlap each other in a direction perpendicular to the longitudinal direction in the binding position.

3. The binding tool according to claim 1, wherein the first base member and the second base member are stacked in a multi-layer structure including a clearance in the binding position.

4. The binding tool according to claim 1, wherein the first base member and the second base member are coupled to each other to be movable in the width direction through a coupling member.

* * * * *